US005919519A

United States Patent [19]

Tallis

[11] Patent Number: 5,919,519

[45] Date of Patent: Jul. 6, 1999

[54] POTABLE WATER SUPPLY COMPONENTS

[75] Inventor: Colin E Tallis, Leeds, United Kingdom

[73] Assignee: IMI Yorkshire Fittings Limited, Leeds, United Kingdom

[21] Appl. No.: 08/443,268

[22] Filed: May 17, 1995

[30] Foreign Application Priority Data

May 17, 1994 [GB] United Kingdom ..... 9409811

[51] Int. Cl.[6] ..... B05D 7/22; C23C 8/06

[52] U.S. Cl. ..... 427/239; 148/282; 148/253; 148/254; 138/145; 427/318; 427/399

[58] Field of Search ..... 427/239, 318, 427/399; 148/282, 253, 254; 138/145; 428/34.6, 35.3, 35.5, 472.3

[56] References Cited

U.S. PATENT DOCUMENTS

| | | | |
|---|---|---|---|
| 2,711,391 | 6/1955 | Kahler | 148/253 |
| 2,834,659 | 5/1958 | Mathre et al. | 41/42 |
| 3,420,715 | 1/1969 | Ayres | 148/253 |
| 3,879,231 | 4/1975 | Watanabe et al. | 148/6.15 |
| 4,089,707 | 5/1978 | Shaffer et al. | 148/6.14 R |
| 4,233,088 | 11/1980 | Kronstein | 148/6.16 |
| 5,076,941 | 12/1991 | Boffardi et al. | 210/753 |

FOREIGN PATENT DOCUMENTS

| | | |
|---|---|---|
| 0171043 | 2/1986 | European Pat. Off. . |
| 0430726 | 6/1991 | European Pat. Off. . |
| 0 481 669 A3 | 4/1992 | European Pat. Off. . |
| 0510989 | 10/1992 | European Pat. Off. . |
| 0 587 543 A3 | 3/1994 | European Pat. Off. . |
| 43 13 439 A1 | 10/1994 | Germany . |
| 547408 | 8/1942 | United Kingdom . |
| 741080 | 11/1955 | United Kingdom . |
| 1019869 | 2/1966 | United Kingdom . |
| 1114645 | 5/1968 | United Kingdom . |
| 1273736 | 5/1972 | United Kingdom . |
| 1284147 | 8/1972 | United Kingdom . |
| 1396057 | 5/1975 | United Kingdom . |
| 2270721 | 3/1994 | United Kingdom . |

OTHER PUBLICATIONS

American Army Standard MIL–M–10578 (1980).

Oliphant, WRC, "Changing Perceptions As To The Significance of Potential., Sources of Lead Contamination in Domestic Water Systems", pp. 1–16 (1992) (no mo.).

Boffardi, Materials Performance, vol. 29, No. 8, Aug. 1, 1990.

*Primary Examiner*—Janyce Bell

*Attorney, Agent, or Firm*—Pillsbury Madison & Sutro LLP

[57] ABSTRACT

A method of treating a potable water supply component, for example a pipe, pipe coupling or tap body, made of a leaded copper-based alloy such as a brass or gun metal, in order to inhibit the leach out of lead from the alloy by potable water during service, comprises treating at least internal surfaces of the component with an aqueous solution of an acid that forms a substantially water insoluble compound with lead. The acid is preferably ortho-phosphoric acid.

18 Claims, No Drawings

POTABLE WATER SUPPLY COMPONENTS

This invention relates to potable water supply components made of copper alloys, especially but not exclusively pipe fittings made of leaded brasses.

It is well known to make water pipe fittings, for example pipe couplings and valve and tap bodies, of brass or other copper based alloys such as gun metal. Normally, such alloys need to be free machinable so that, for example, requisite screw threads can readily be machined on the fittings. For that reason, it is well known to add a small quantity, typically from about 1 to 5 wt %, of lead during manufacture of the alloy.

Recently, however, concerns have been expressed, in the context of potable water plumbing systems, that lead might be leached out of such alloys during service, possibly giving rise to a health problem. The present invention seeks to mitigate this problem.

According to the present invention in its broadest aspect, there is provided a method of treating a potable water supply component made of a leaded copper-based alloy in order to inhibit the leach out of lead from the alloy by potable water during service, the method comprising treating at least internal surfaces of the component with an aqueous solution of an acid that forms a substantially water insoluble compound with lead.

Preferably, the acid is an oxy-acid of phosphorus, for example orthophosphoric acid, and the remainder of the body of this specification refers, for convenience, mainly to the use specifically of orthophosphoric acid. However, it is to be understood that alternative acids may, in principle, be used. In this connection, whilst we do not fully understand how the acid treatment functions, it is believed, without in any way limiting the scope of the invention, that the acid stabilizes or "passivates" lead at or near the internal surfaces of the treated component by causing the formation of a physically stable, adherent film of a substantially water insoluble simple or complex lead compound, for example a phosphate in the case where an oxy-acid of phosphorus, such as orthophosphoric acid, is used. In addition, the acid may act during the treatment actually to remove lead present at or near such surfaces.

By the expression "substantially water insoluble" used herein we mean preferably less than 0.01 g/L, and advantageously less than 0.001 g/L, at any temperature between 0 and 25° C.

The specific acid treatment and cleaning conditions mentioned hereinafter in relation to orthophosphoric acid generally apply also to the use of such other acids and, in any event, the optimum conditions may be determined by simple trial and experiment.

Preferably, the phosphoric acid is a technical or general purpose grade phosphoric acid comprising principally orthophosphoric acid, optionally together with relatively small amounts of other oxyacids of phosphorus such as pyrophosphoric acid. The phosphoric acid is preferably in the form of a dilute aqueous solution thereof, for example from 1 to 30% vol and preferably from 10 to 20% vol.

The phosphoric acid treatment may be carried out at substantially any ambient room temperature, although it is preferred to carry it out between 20 and 80° C., more preferably between 25 and 40° C., say around 35° C., for an extended period of time, say for between 30 and 120 minutes and typically between 60 and 90 minutes.

Also preferably, at least the internal surfaces of the component are cleaned, especially degreased, prior to the treatment with the acid. This may be effected using, for example, a mild detergent solution, preferably with simultaneous agitation, for example mechanical or ultrasonic agitation. Agitation, for example mechanical or ultrasonic agitation, may also be carried out during the phosphoric acid treatment step.

After the phosphoric acid treatment step, the component is preferably rinsed with water, and then allowed to dry or forcibly dried in a stream of hot air.

Whilst, of course, it is necessary to treat, in accordance with the invention, only those internal surfaces of the component that will come into contact with potable water during service, it is, where the treatment is carried out during manufacture of the component, expedient to immerse the whole component in, for example, a bath, a number of components preferably being treated simultaneously in a batch process.

Alternatively, however, the method of the invention may be performed in situ on a potable water supply installation. To that end, the acid solution would be introduced into the installation's pipework, following an optional cleaning/degreasing step, and allowed to remain in the pipework for, say, 1 to 2 hours whereafter the pipework would be flushed out with water and then put into, or back into, service.

In another aspect, the present invention provides a potable water supply component, for example a pipe or pipe fitting, made of a leaded copper-based alloy, which has been treated by the method defined above.

The following Examples illustrate the efficacy of the method of the invention.

EXAMPLE 1

Twelve replicate, machined specimens of leaded dezincification-resistant brass (British Standard Institution's designation CZ132) were prepared in accordance with Annex A.4.1 of British Standard 7766:1994 entitled "Assessment of the potential for metallic materials to affect adversely the quality of water intended for human consumption" (previously embodied in the British Standard Institution's publication DD201:1991), the content of which is incorporated herein by way of reference thereto. CZ132 brass contains 1.7–2.8 wt % lead, 0.08 to 0.15 wt % arsenic, 35 to 37 wt % zinc, balance copper apart from up to 0.5 wt % incidental impurities.

One of each of the replicate specimens was degreased in an ultrasonic tank using a 5% aqueous solution of a detergent (ex Canning) at 35° C. They were then immersed in 20% general purpose grade orthophosphoric acid (GPR grade from BDH) for 1½ hours at 35° C. with occasional agitation. The specimens were then thoroughly rinsed with deionised water and dried in hot air.

The other of each of the replicate specimens was similarly treated, save that the orthophosphoric acid immersion step was omitted.

All twenty four specimens were then subjected to the extractive step set out in Annex A5 of BS7766:1994 and the extracts were analysed for lead using a carbon furnace atomic absorption spectrophotometer. The results obtained are shown in the following Table 1.

TABLE 1

| Specimen No | Pb concentration Final Extract (ug/L) $H_3PO_4$ treated | Pb concentration Final Extract (ug/L) Untreated |
|---|---|---|
| 1 | 26.6 | 73.3 |
| 2 | 28.3 | 100.8 |
| 3 | 27.7 | 500.0 |
| 4 | 24.6 | 57.0 |
| 5 | 30.9 | 68.1 |
| 6 | 30.6 | 58.7 |
| 7 | 27.7 | 47.4 |
| 8 | 29.9 | 45.3 |
| 9 | 31.4 | 103.0 |
| 10 | 34.8 | 53.4 |
| 11 | 31.7 | 55.6 |
| 12 | 30.5 | 100.0 |

The "overall result", as defined in Annex A.7.1 of BS7766:1994, multiplied by 0.25 (see Section 3.1 of the Specification of BS7766:1994) for the orthophosphoric acid treated specimens was therefore 8.69 ug/L, i.e. well below the maximum permitted lead level of 50 ug/L, whereas the overall result×0.25 for the untreated control specimens was 86.66 ug/L, i.e. well above the maximum permitted lead level.

EXAMPLE 2

A number of replicate cast specimens of gun metal designated "LG1" in British Standard 1400:1985 were prepared as in Example 1, save that they were left unmachined, ie. were in their as cast form. LG1 contains from 2.0 to 3.5 wt % tin, from 7.5 to 9.5 wt % zinc, from 4.0 to 6.0 wt % lead, from 0 to 2.0 wt % nickel, balance copper apart from incidental impurities.

The specimens were cleaned under the conditions shown in the following Table 2 and replicate ones were further treated with a 20 % vol aqueous solution of orthophosphoric acid under the conditions shown also in Table 2. The right hand column shows the "overall result"×0.25 of the extractive step described in BS7766:1994. Whilst, compared with untreated CZ132 alloy, significantly less lead is leached out of untreated LG1, it is evident that phosphoric acid—treated LG1 shows a marked improvement.

TABLE 2

| Alloy | Cleaning Step | $H_3PO_4$ - Treatment Step | Overall Result x0.25 ug/L |
|---|---|---|---|
| LG1 | 5% Canning at 50° C. + ultrasonic agitation | — | 17.0 |
| LG1 | 5% Canning at 50° C. + ultrasonic agitation | 20% vol at 50/80° C. for 40 minutes + ultrasonic agitation | 8.0 |

I claim:

1. In a method of manufacturing a potable water supply component from a leaded copper-based alloy, the improvement whereby the leaching out of lead from the alloy by potable water during service is inhibited, said improvement comprising treating at least internal surfaces of the component which are to later contact the water with an effective amount of an aqueous solution of an acid that forms a substantially water insoluble compound with lead, the treatment with said acid being sufficient to inhibit said leaching out of lead by contact of said internal surfaces with potable water during service.

2. A method according to claim 1 wherein the acid is selected from one or more oxy-acids of phosphorus.

3. A method according to claim 2 wherein the acid comprises orthophosphoric acid.

4. A method according to claim 1 wherein the acid has a concentration within the range of from 1–30% vol.

5. A method according to claim 4 wherein the acid has a concentration of about 10–20% vol.

6. A method according to claim 1 which is carried out at a temperature between 20 and 80° C.

7. A method according to claim 6 which is carried out at a temperature between 25 and 40° C.

8. A method according to claim 7 which is carried out at a temperature of about 35° C.

9. A method according to claim 1 wherein the acid treatment step is carried out for between 30 and 120 minutes.

10. A method according to claim 9 wherein the acid treatment step is carried out for between 60 and 90 minutes.

11. A method according to claim 10 wherein, additionally, at least said internal surfaces of the component are cleaned with a cleaning solution prior to being treated with the acid.

12. A method according to claim 11 wherein the cleaning solution includes a detergent.

13. A potable water supply component made by the method claimed in claim 1, said component having a reduced tendency for lead therein to leach out by contact with potable water during subsequent use.

14. A pipe or pipe fitting according to claim 13.

15. In a method of manufacturing a potable water supply component from a leaded copper-based alloy, the improvement whereby the leaching out of lead from the alloy by potable water during service is inhibited, said improvement comprising treating at least internal surfaces of the component which are to later contact the potable water with an aqueous solution containing, as the sole essential treating agent, an effective amount of an oxy-acid of phosphorus that forms a substantially water-insoluble compound with lead, the treatment being sufficient to inhibit the lead from leaching out by contact of said internal surfaces with potable water during service.

16. A method according to claim 15 wherein the acid is orthophosphoric acid.

17. A method according to claim 16 wherein said aqueous solution contains from 1 to 30 % vol. orthophosphoric acid.

18. A method according to claim 17 wherein said aqueous solution contains from 10 to 20 % vol. orthophosphoric acid.

* * * * *